US006084545A

United States Patent [19]

Lier et al.

[11] Patent Number: 6,084,545

[45] Date of Patent: Jul. 4, 2000

[54] NEAR-FIELD CALIBRATION SYSTEM FOR PHASE-ARRAY ANTENNAS

[75] Inventors: Erik Lier; Daniel Sanford Purdy, both of Newtown, Pa.; Jeffrey Michael Ashe, Gloversville, N.Y.; Anthony Wykeham Jacomb-Hood, Yardley; Vladimir Volman, Newtown, both of Pa.

[73] Assignee: Lockheed Martin Corporation, Sunnyvale, Calif.

[21] Appl. No.: 09/352,508

[22] Filed: Jul. 12, 1999

[51] Int. Cl.[7] ..... H01Q 3/00

[52] U.S. Cl. ..... 342/360; 342/174; 342/374

[58] Field of Search ..... 342/165, 174, 342/360, 372, 374

[56] References Cited

U.S. PATENT DOCUMENTS 5,160,933 11/1992 Hager ..... 342/174
5,248,982 9/1993 Reinhardt et al. ..... 342/375
5,530,449 6/1996 Wachs et al. ..... 342/174
5,790,071 8/1998 Silverstein et al. ..... 342/354

*Primary Examiner*—Thomas H. Tarcza
*Assistant Examiner*—Dao L. Phan
*Attorney, Agent, or Firm*—W. H. Meise

[57] ABSTRACT

A near-field calibration arrangement for a phased-array antenna determines the phase shifts or attenuation of the elemental control elements of the array. The calibration system includes a probe located in the near field, and a calibration tone generator. The tone generator is coupled to the probe in the case of calibration of a receive antenna, and to the signal port of the array in the case of calibration of a transmit antenna. A code generator generates sets of values, with each set being orthogonal to the others. The codes are applied to the control input port of the array antenna, so that the codes encode the tone passing through the antenna. The encoded tones are applied to a decoder and processor, which processes the signals to determine the phase shift or attenuation associated with each bit of the control signal.

7 Claims, 5 Drawing Sheets

NEAR-FIELD CALIBRATION SYSTEM FOR PHASE-ARRAY ANTENNAS

FIELD OF THE INVENTION

This invention relates to calibration of the elements of active or passive antenna arrays, and more particularly to separate calibration of receive antenna arrays and transmit antenna arrays.

BACKGROUND OF THE INVENTION

Antenna arrays are well known, and are finding increasing use. Active antenna arrays which switch from transmit to receive modes, for use in systems such as radar, include both power amplifiers and low-noise receivers, and some method for switching from transmit mode to receive mode. This mode of operation is advantageous in that it allows the antenna elements themselves, and possibly the control elements, including the phase shifters and the attenuators (or amplifier gains), to be used for both the transmit and receive modes of operation.

In some applications, such as repeaters, the signals which must be handled are continuously received, and must be continuously retransmitted. For repeater use, active antenna arrays which switch from transmit to receive operation are not useful, for they must give up one of transmission or reception while performing the other function.

In critical applications, there must be some way to align the antenna beam(s) of an array antenna. The alignment is performed by controlling the phase shifters andor attenuators associated with each antenna element or group of antenna elements in such a manner as to generate the desired beam shape and direction. Antenna controllers, also known as Antenna Control Units (ACU) which provide such control are also well known. In digitally controlled systems, the phase shifters and the attenuators (which may include gain control of an amplifier) are controlled by digital signals. The smallest unit of control which can be achieved in a digital system is defined by a one-bit change in the signal. The phase change provided by a phase shifter, and the attenuation change provided by an attenuator, are controlled by a multibit control signal, as for example a five-bit control signal, in which any one value represents one of 32 possible states. When the number of bits of the control signal is so limited, the corresponding change in control provided by the phase shifter or attenuator is usually the maximum available change divided by the number of states represented by the control signal. In the five-bit control signal example, assuming that the maximum possible phase shift provided by a phase shifter is 360°, the smallest increment of control is designed to be 360° divided by 32, or slightly more than 10° per bit.

The actual phase shift of a phase shifter, and the actual attenuation of an attenuator, at a given value of the digital control signal, may deviate from the nominal value. The cumulation of these errors may substantially affect the accuracy with which the ACU can point the beam(s) in the desired direction, andor establish the desired beamshape. For this reason, various calibration schemes have been proposed. In this context, the term "calibration" means the process of determining the (one-to-one) relationship between the phase or amplitude of the input and output signals of a controllable phase shifter or attenuator for a given control input signal state. One simple calibration scheme is to measure the phase shift of each phase shifter, and the attenuation of each attenuator, before it is mounted in the antenna array, and to provide the resulting data to the ACU as an indication of the expected phase or attenuation of the control unit in the presence of a given digital input signal. This type of calibration scheme does not take into account changes which may occur in the performance of the various control elements due to aging, voltage variations which may be experienced, temperature effects, transmission-line impedance effects, and the like.

Improved calibration arrangements are desired.

SUMMARY OF THE INVENTION

A near-field calibration system calibrates at least one of (either or both of) the phase and amplitude controllers of the individual elements of a phased-antenna array, which may be either active or passive. The phased-antenna array includes a signal port for each antenna beam which is generated, and also includes a control signal input port to which control signals may be applied for control of the phase and amplitude controllers. The phased-antenna array can be operated in a normal signal-handling mode and in a calibration mode. A calibration probe is held at a fixed location relative to the phased-antenna array, and within the near-field of the phased-antenna array. A calibration tone generator generates a calibration tone signal. The calibration tone generator is (a) coupled to at least one of the signal ports of the phased-antenna array for the case in which the phased-antenna array is used as a transmit antenna during normal operation, or is (b) coupled to the calibration probe for the case in which the phased-antenna array is used as a receive antenna during normal operation. A calibration encoding arrangement is coupled to the beam conditioning control port of the phased-antenna array, for, during calibration, sequentially setting at least some of the phase shifters (or attenuators, or both) of the phased-antenna array with a plurality of sets of values. Each of the sets of values set by the encoding arrangement imposes a coding on the calibration tone signal, to thereby sequentially generate calibration signals encoded with a set of values. Each set of values so encoded onto the calibration signals is orthogonal to other sets of values with which the calibration signals are encoded. As a result, in the case in which the phased-antenna array is used as a transmit antenna during normal operation, the calibration probe receives the calibration tone signals sequentially encoded with mutually orthogonal values, and in the case in which the phased-antenna array is used as a receive antenna during normal operation, the calibration tone signals sequentially encoded with mutually orthogonal values are generated at the at least one of the signal ports of the phased-antenna array. The system includes a decoder for decoding signals encoded with the mutually orthogonal values, for generating decoded signals therefrom. An encoded signal coupling means is (a) coupled to the calibration probe and to the decoder in the case in which the phased-antenna array is operated as a transmit antenna in the normal mode of operation and (b) coupled to the decoder and to the signal port of the phased-antenna array in the case in which the antenna is operated as a receive antenna in the normal mode of operation, for coupling the encoded signals to the decoder. Consequently, the decoder provides decoded signals. A processor is coupled to the decoder, for processing the decoded signals, for generating signals representing at least values of one of phase shift and attenuation, or both if appropriate. A coupling arrangement is coupled to the processor and to the antenna control unit, for coupling to the antenna control unit the signals representing at least the values of phase shift, attenuation, or both, which may have been determined by the calibration system.

An antenna system according to an aspect of the invention includes an transmit antenna array. The transmit antenna array includes a signal port, and also includes a beam conditioning (beam-forming) control input port coupled to at least controllable phase shifters. A transmit calibration probe is at a nominal location in the near field of the transmit array. The term "near-field" as used herein means that the probe is placed nominally in close proximity such that it is effectively co-located with the phased-array antenna. While the term normally is taken to mean a distance no greater than $2D^2/\lambda$, where D is the dimension of the antenna, and $\lambda$ is the free-space wavelength, this distance is really the distance at which phase errors across the antenna aperture are deemed to be insignificant, and this consideration varies with the application. A transmit antenna switching arrangement including at least common, calibration, and transmit ports, with the common port being coupled to the signal port of the transmit array. A source of transmit antenna array calibration signals is provided. A transmit antenna array calibration signal coupler is coupled to the transmit antenna array calibration signal source and to the calibration port of the transmit switching arrangement, for controllably coupling the transmit antenna array calibration signals to the transmit antenna array, so that the transmit antenna array calibration signal is transmitted by the transmit antenna array. A transmit calibration encoder is coupled to the beam conditioning control port of the transmit antenna, for, during calibration, sequentially setting at least some of the phase shifters of the transmit antenna array with a plurality of sets of values. Each of the sets of values imposes a coding on the transmit antenna array calibration signals, to thereby sequentially generate calibration signals encoded with a set of values, with each set of values so encoded onto the calibration signals being orthogonal to other sets of values with which the calibration signals are encoded. As a result, the transmit antenna array calibration probe receives the transmit antenna array calibration signals sequentially encoded with mutually orthogonal values.

The system also includes an receive antenna array including a signal port and a beam conditioning control input port coupled to at least controllable phase shifters of the receive antenna array. A receive calibration probe is affixed at a location in the near field of the receive array. A receive antenna switching arrangement includes at least common, calibration, and receive ports, with the common port being coupled to the signal port of the receive antenna array. The system also includes a source of receive antenna array calibration signals. A receive antenna array calibration signal coupler is coupled to the receive antenna array calibration signal source and to the receive calibration probe, for controllably coupling the receive antenna array calibration signals to the receive calibration probe. As a result, the receive antenna array calibration signal is transmitted by the receive calibration probe and is received by the receive antenna array. A receive calibration encoder is coupled to the beam conditioning control port of the receive antenna, for, during calibration, sequentially setting at least some of the phase shifters of the receive antenna array with a plurality of sets of values, each of the sets of values thereby imposing a coding on the receive antenna array calibration signals. This, in turn, sequentially generates receive antenna array calibration signals encoded with a set of values. Each set of values so encoded onto the receive antenna array calibration signals is orthogonal to other sets of values with which the receive calibration signals are encoded. Consequently, the receive antenna array receives the receive antenna array calibration signals sequentially encoded with mutually orthogonal values. A transmit/receive calibration switch includes a transmit signal port, a receive signal port, and a common port, for coupling signals applied to either (one of) the transmit signal port or (and) the receive signal port to the common port. A first coupler is coupled to the transmit calibration probe and to the transmit signal port of the transmit/receive calibration switch, for coupling the transmit antenna array calibration signals sequentially encoded with mutually orthogonal values to the transmit/receive calibration switch, whereby the transmit antenna array calibration signals sequentially encoded with mutually orthogonal values are produced at the common port of the transmit/receive calibration switch in a transmit antenna array calibration mode of operation. A second coupler is coupled to the calibration port of the receive antenna switching arrangement and to the receive signal port of the transmit/receive calibration switch, for coupling the receive antenna array calibration signals sequentially encoded with mutually orthogonal values to the transmit/receive calibration switch, whereby the receive antenna array calibration signals sequentially encoded with mutually orthogonal values are produced at the common port of the transmit/receive calibration switch in a receive antenna array calibration mode of operation. An analog-to-digital converter includes an input port coupled to the common port of the transmit/receive calibration switch, for converting into digital form those analog signals applied to the input port of the analog-to-digital conversion means, to thereby generate a digital version of the transmit antenna array calibration signals sequentially encoded with mutually orthogonal values in the transmit antenna array calibration mode of operation, and a digital version of the receive antenna array calibration signals sequentially encoded with mutually orthogonal values in the receive antenna array calibration mode of operation. A signal processor is coupled to the analog-to-digital converter, for decoding that one of the digital version of the transmit antenna array calibration signals sequentially encoded with mutually orthogonal values and the digital version of the receive antenna array calibration signals sequentially encoded with mutually orthogonal values which is produced by the analog-to-digital conversion means, to thereby generate signals representing the relationship between a bit of each of the phase shifters and the resulting phase.

In a particular version of this embodiment, each of the first and second signal couplers includes an electromagnetic filter for rejecting unwanted frequencies, to thereby generate filtered signals, and a frequency converter coupled to the filter for frequency converting the filtered signals. In another version, the first and second signal couplers includes a frequency converter, which may be a downconverter.

DESCRIPTION OF THE INVENTION

Figure 1:
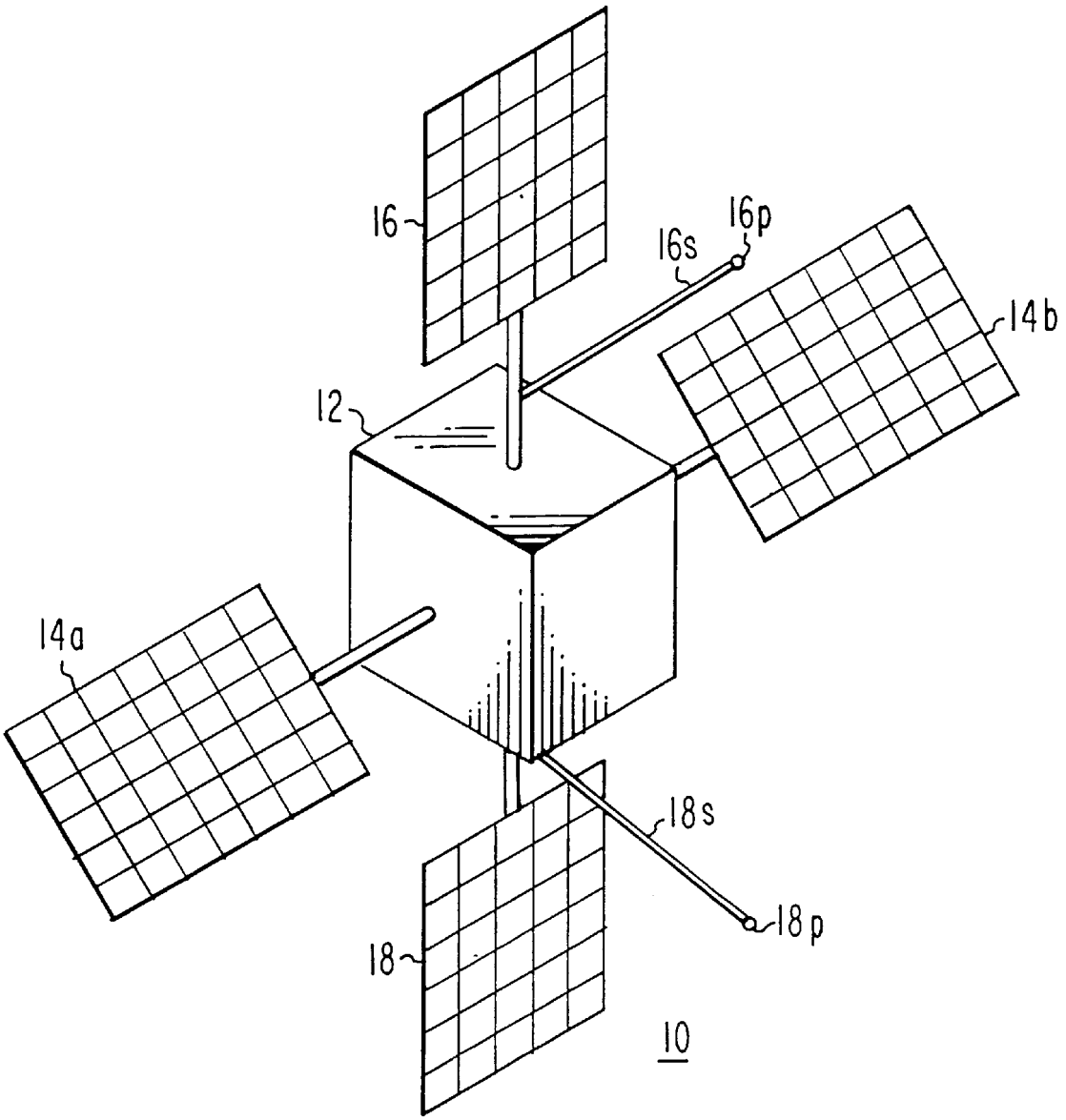
FIG. 1 is a simplified illustration of a spacecraft on which a calibration arrangement according to an aspect of the invention may be mounted.

FIG. 1 is a simplified illustration of a spacecraft on which a calibration arrangement according to an aspect of the invention may be mounted. In FIG. 1, a spacecraft 10 includes a body 12, illustrated as a rectangular block. Body 12 supports first and second solar panels 14*a* and 14*b*, which are mounted to track the sun, for producing electricity for powering the various electrical portions of the spacecraft 10. Body 12 of spacecraft 10 also supports an array antenna 16, which may be dedicated to a receiving function. An array antenna 18 is dedicated to a transmitting function. receiving antenna array 16 is associated with a receive antenna calibration antenna or probe 16*p* held in a fixed nominal position before receiving antenna array 16 by a support 16*s*. The nominal position of the probe relative to the associated array 16 is known, so the radius $r_n$ from the probe to any element n of the array 16 is known. transmit antenna array 18 is associated with a transmit antenna calibration antenna or probe 18*p* held in a fixed nominal position before transmit antenna array 18 by a support 18*s*.

Figure 2:
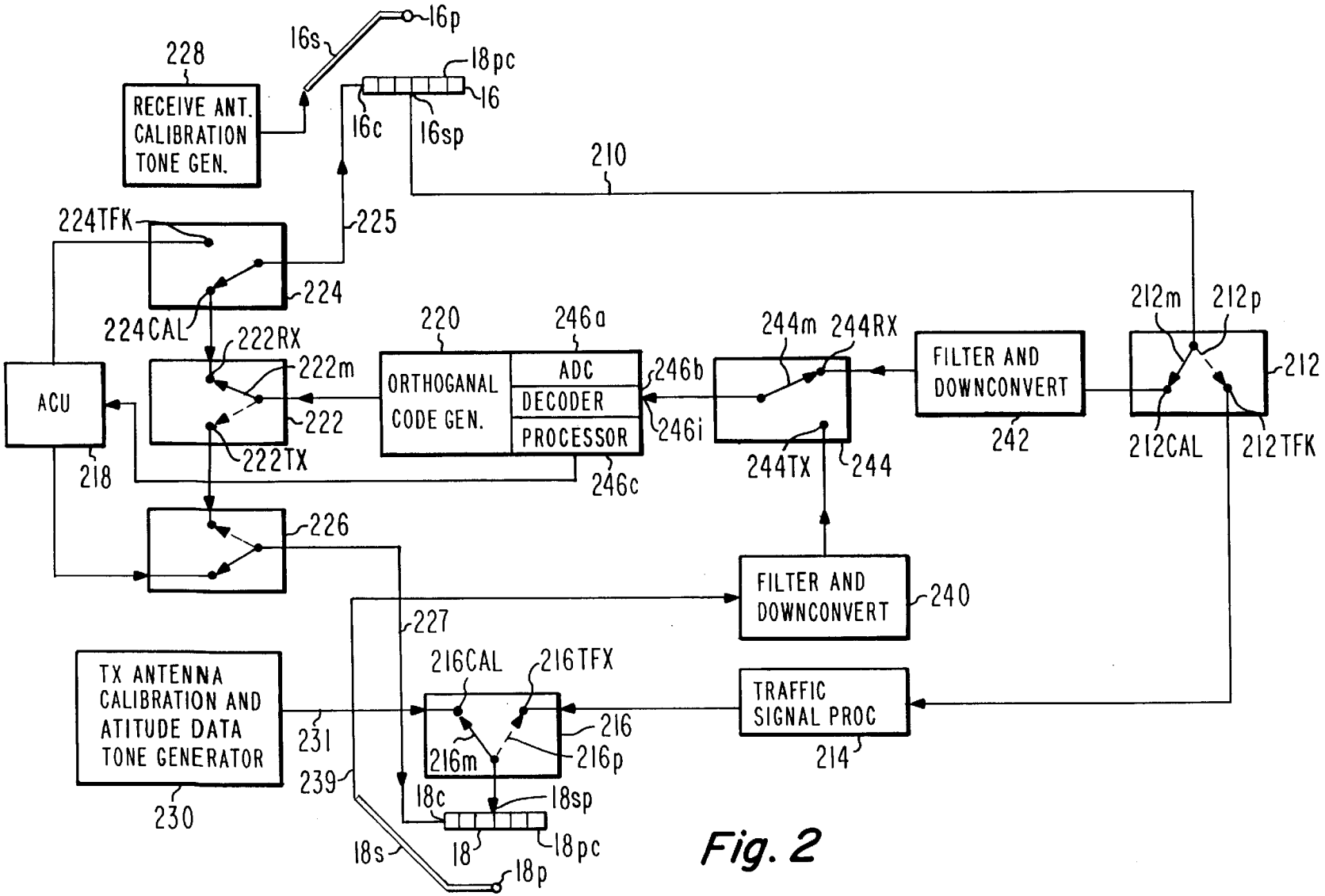
FIG. 2 is a simplified block diagram of various systems associated with the antennas of FIG. 1.

FIG. 2 is a simplified block diagram of various systems associated with antennas 16 and 18 of FIG. 1. In FIG. 2, receive antenna array 16 includes a signal port 16*sp*, from which signals received by the receive antenna array 16 are coupled to a common movable element 212*m* of a switch illustrated as 212. receive antenna array 16 also includes a control or beam conditioning input port 16*c*, to which digital control signals are applied for control of the state of all of the control elements (phase shifters and attenuators or gain-control amplifiers) of the array. In general, there is one phase shifter and one attenuator for each antenna element of the array 16.

The signals produced at port 16*sp* of antenna 16 of FIG. 2 are applied to the common port of a switching arrangement illustrated as a mechanical single-pole, double-throw switch 212. Those skilled in the art know that representation of a switch by its mechanical equivalent is for simplicity only, and that electronic switching arrangements are preferred in most applications. Further, those skilled in the art know that the signals may be such as to require many separate switchable paths in order to accomplish the desired switching function, and no further explanation is required. Switch 212 as illustrated includes a movable common element 212*m* which can be switched between contact with a calibration (CAL) terminal and contact with a traffic (TFK) terminal. The traffic terminal of switch 212 is connected to a traffic signal processing block 214, which performs processing which may be applicable to the traffic signals before transmissions are performed. In one common aspect, processing block 214 represents frequency-shifting of the signals which are to be retransmitted to the Earth, and in one aspect performs routing of signals of various frequencies so that they are applied to selected ports of one or more beamformers (not illustrated) which determine which of several beams carries that particular signal to its destination. The beams may be spot beams or other shaped beams. The processed signals from block 214 are applied to the traffic (TFK) port of a switching arrangement 216. Switching arrangement 216 includes a common movable element 216*m* which is switchable to contact either a traffic (TFK) terminal or a calibration (CAL) terminal. The common element 216*m* is connected to the signal port 18*sp* of transmit array antenna 18.

In the traffic-handling mode of operation, switch arrangements 212 and 216 are in their alternate positions (the positions indicated by the phantom movable elements 212*p* and 216*p*). With the switches 212 and 216 so set, the traffic signals received by receive antenna 16 are coupled through switch 212 to traffic signal processor 214. The resulting processed traffic signals are applied through switch 216 to signal port 18*sp* of transmit array antenna 18, which transmits the traffic signals to the Earth.

In the described flow of traffic signals, the signals received by receive array antenna 16 are expected to be received from particular regions of the Earth's surface which the beam(s) of the receiving antenna array 16 illuminate under control of beam control signals, generated by an antenna control unit (ACU) illustrated as a block 218, and applied to control signal input port 16*c* of receiving antenna array 16. The concept of illumination of a region is well known in the antenna arts, and is not further described. Similarly, the signals transmitted by transmit antenna array 18 are intended to illuminate particular region(s) of the surface under the control of the control signals generated by ACU 218 and applied to control signal input port 18*c* of transmit antenna array 18. In order to assure that the beam direction andor shape as controlled by ACU 218 are those intended, it may be desirable to perform a calibration from time to time in order to determine the actual phase shift imparted by the various phase shifters andor the attenuators of the receive antenna array 16 or the transmit antenna array 18.

In FIG. 2, an orthogonal code generator 220, when enabled, sequentially generates antenna element control signals. These control signals are applied to the movable element m of a switching arrangement (switch) 222, which includes transmit (TX) and receive (RX) terminals. When switch 222 is in the illustrated condition or state, the antenna element control signals produced by orthogonal code generator block 220 are applied to control signal input port 16*c* of receive antenna array 16. A switch 224 is ganged with switch 222, to switch off (prevent the antenna 16 from receiving) the receive antenna array 16 control signals produced by ACU 218 during those intervals in which the encoder control signals are applied to the receive antenna array 16. On the other hand, when switch 222 is in its alternate switching condition or state, illustrated by the phantom position of movable element 222*m*, the encoder signals are applied by way of switch 222 to the control signal input port 18*c* of transmit antenna array 18. During those intervals in which switch 222 routes the control signals from orthogonal code generator 220 to control signal input port 18*c* of transmit antenna array 18, a switch 226, which is ganged with switch 222 for simultaneous actuation therewith, decouples the control signals generated by ACU 218 from the control input port 18*c* of transmit antenna array 18. Thus, in a calibration mode of operation, depending upon the position of switch arrangement 222 (and of the switches 224 and 226 ganged therewith), the encoding signals generated by orthogonal code generator block 220 are coupled to the control signal input port of either the receive antenna array 16 or the transmit antenna array 18.

The signals produced by orthogonal code generator 220 are known signal sets such as those described, for example, in U.S. Pat. No. 5,572,219, issued Nov. 5, 1996 in the name of Silverstein et al., and their application to near-field calibration is described below.

In FIG. 2, a receive antenna array calibration tone generator 228 is connected by way of support 16*s* to receive antenna array probe or antenna 16*p*. When generator 228 is enabled, the tone is generated, and radiated by probe 16*p*. receive antenna array 16 receives the tone, modulated or encoded by the calibration control signal from orthogonal code generator block 220. Thus, the signal produced at receive antenna array signal port 16*sp* is the receive antenna array calibration tone encoded or modulated with the calibration control signal from block 220.

In FIG. 2, a transmit antenna array calibration tone generator 230 is connected to a calibration (CAL) terminal of switch arrangement 216. In the calibration mode of operation, the common movable element 216*m* of switch 216 makes contact with calibration terminal CAL, and the tone is applied to the signal input port 18*sp* of transmit antenna array 18. Also in the calibration mode of operation, the control signals produced by orthogonal code generator 220 are applied over switches 222 and 226 (in their alternate positions, indicated by dash lines) to the control input port 18*c* of transmit antenna array 18. As a result of the application of the control signal to control signal input port 18*c*, the transmit calibration tone applied as radiated by transmit antenna array 18 is encoded with or modulated by the signal generated by orthogonal code generator 220. The modulated or encoded transmitted signal is received by probe 18*p* and coupled by way of a transmission line extending through support 18*s* to a receiver arrangement 240, which may be as simple as a filter for excluding unwanted signals, a downconverter, or a cascade of a filter with a downconverter.

The received signals from blocks 240 and 242 are applied to a switching arrangement 244, which is illustrated as including a receive (RX) terminal, a transmit (TX) terminal, and a common movable element 244*m*. In the RX position of switch 244, the encoded or modulated calibration signal from the receive antenna array 16 is coupled to a block 246*a*, and in the TX position of switch 244, the encoded or modulated calibration signal from the transmit antenna array 18 is coupled to block 246*a*. Block 246*a* represents an analog-to-digital converter for converting the analog signals into digital form, block 246*b* represents a decoder, and block 246*c* represents a processor, for decoding the encoded or modulated calibration signals, and for determining the phase shifts andor attenuations represented by the various bits of the control signals. The resulting information is applied over a signal path represented as 248 to the antenna control unit 18, to update the ACU with current phase shift and attenuation values.

Figure 3:
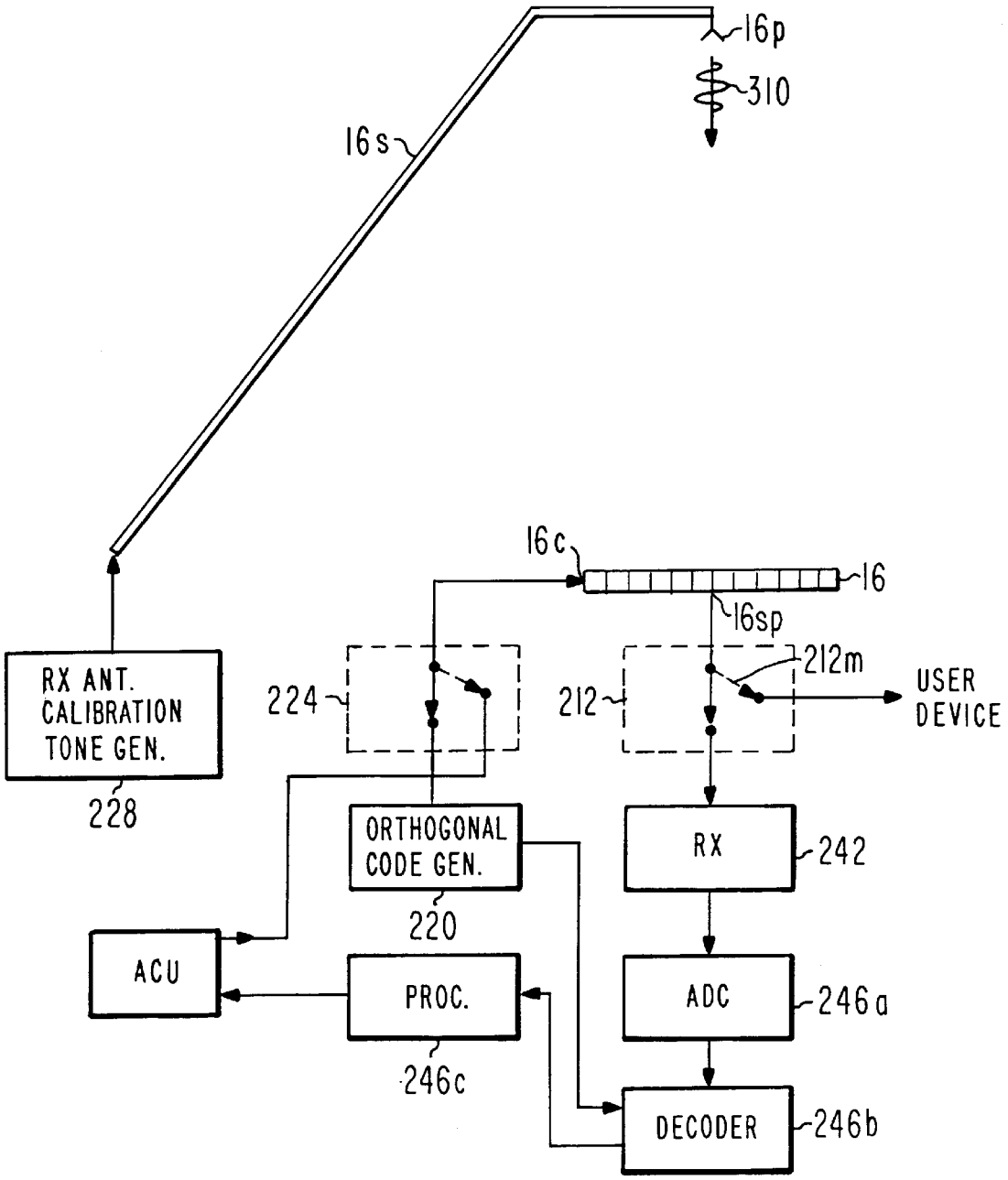
FIG. 3 is a simplified diagram in block and schematic form of an receive antenna array calibration scheme according to an aspect of the invention.

The arrangement of FIG. 3 is particularly advantageous for use on a spacecraft, because the signal-to-noise ratio can be favorable by comparison with remote arrangements in which the calibration signal source is on the Earth. Also, the on-board calibration scheme allows the antenna to be tested on the Earth before launch of the spacecraft. Also, the arrangement of FIG. 2 re-uses parts of the calibration structure, which is advantageous in a spacecraft context.

FIG. 3 is a simplified diagram in block and schematic form of an receive antenna array calibration scheme according to an aspect of the invention. In essence, the arrangement of FIG. 3 is a subset of the arrangement of FIG. 2, lacking the transmit antenna array calibration arrangement. In FIG. 3, elements corresponding to those of FIG. 2 are designated by like reference numerals. In FIG. 3, the signal from receive block 242 is coupled to an ADC block 246*a*, which converts the analog signals into digital form (if necessary). The digital signals are applied to a decoder block 246*b*, which decodes the signals. The processor of block 248*c* determines, from the decoded signals, the phase shift or attenuation values which the elemental phase shifters or attenuators take on in response to the various bits of the control signal. As in the arrangement of FIG. 2, the tone generator 228 couples a calibration tone signal to near-field probe or antenna 16*p*, which transmits the tone, as suggested by photon symbol 310. The receiving antenna array 16 receives the signal from antenna or probe 16*p*, together with traffic signals (if any) from other sources, and modulates the received signal in accordance with the control signals applied to control signal input port 16*c*. The modulated received signals are produced at signal port 16*sp*. In a traffic mode of operation, movable element 212*m* of switch 212 couples the received signals to a user device (not illustrated). In a calibration mode of operation, switch 212 couples the modulated tone to receiver 242. As in the arrangement of FIG. 2, orthogonal code generator 220 produces appropriate orthogonal signal streams, which, when coupled to control input port 16*c* by switch 224 in a calibration mode, cause the received signal (the tone and the traffic signals) at port 16*sp* to be modulated with the coding. The signals so received are applied to receiver 242, and the received signals are coupled to a decoder 246*a*. the decoded signals are applied to the processor 246*b*, which produces signals representing the values of the phase shifts associated with each phase bit value of the control signal, the attenuation associated with each attenuation bit value of the control signal, or both. These signals are made available over a signal path 248 to an ACU 218. In a traffic mode of operation, the ACU control signals are coupled over switch 224 to the control input port 16*c* of receive antenna array 16.

The arrangement of FIG. 3 for near-field calibration of the phase of the phase shifters, amplitude controllers, or both, which are associated with each of the elements of the receive array 16, provides an improvement over the abovementioned technique described by Silverstein et al., because the Silverstein technique is a far-field measurement, and as such requires a remote site, and the need for coherent or synchronous reception, in conjunction with the remote site, in turn requires a communication path for synchronization, which introduces system complications. The use of a near-field probe allows the calibration to be performed in a simpler manner. Knowledge of the radiation patterns of the individual elements of the array, and their locations in the array and relative to the probe, allow the computation of correction factors. These correction factors are then used to correct or calibrate the near-field measurements to determine the far-field radiation patterns which result from various phase or amplitude controller settings. These correction factors would apply to either a receive phased-array antenna as in FIG. 3, a transmit phased-array antenna as in FIG. 4*a*, or both. Put another way, the near-field probe measurements are used to determine far-field results, so that the phase-shifter and amplitude-controller settings associated with the array elements, which give the desired far-field radiation patterns, can be determined. Once the phase shifter and amplitude controller settings have been determined or normalized to given far-field patterns, the array is calibrated. Details of the calibration technique are described below in conjunction with FIG. 4*b*.

Figure 4A:
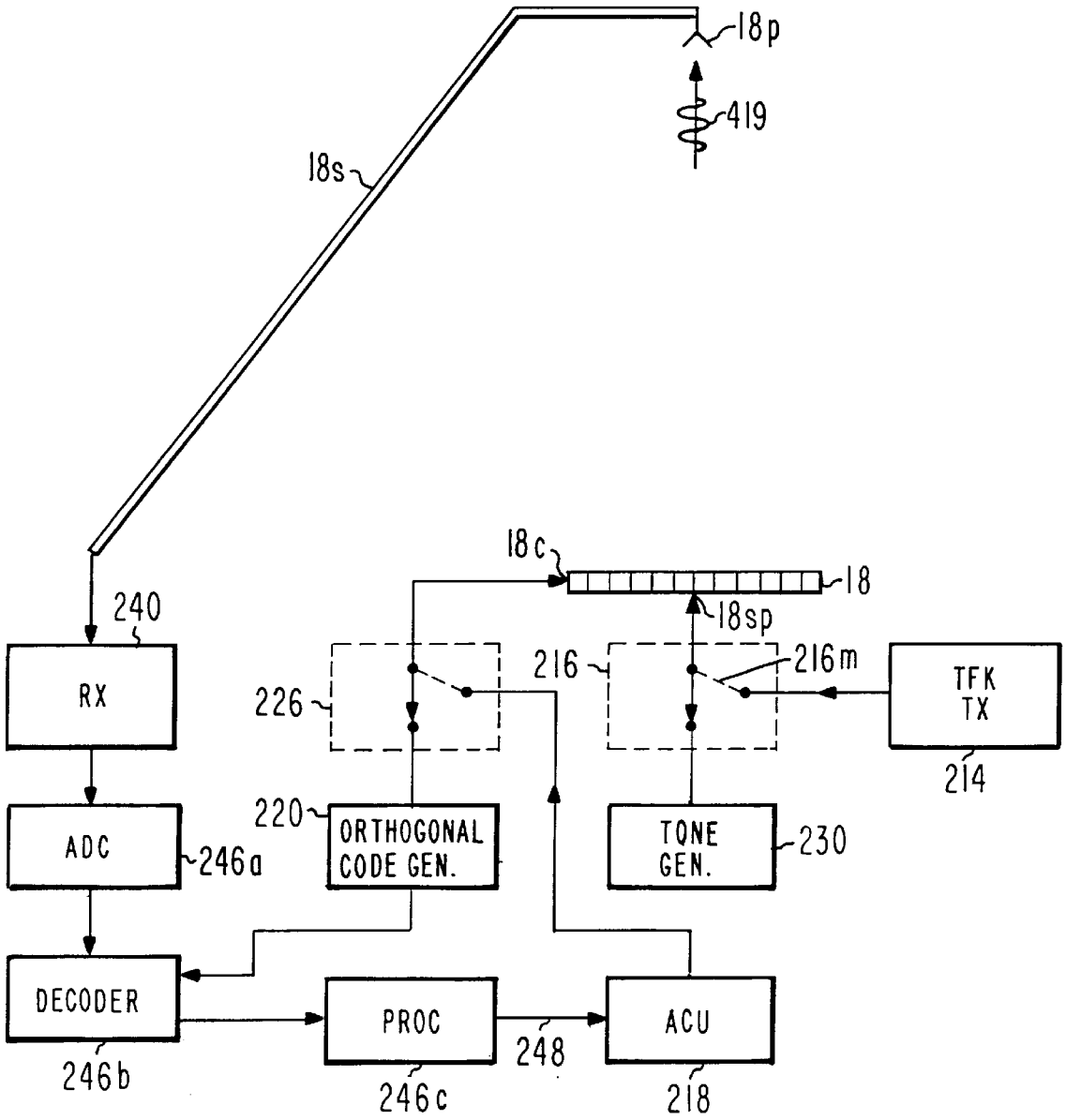
FIG. 4*a* is a simplified diagram in block and schematic form of an transmit antenna array calibration scheme according to an aspect of the invention.

In FIG. 4*a*, tone generator 230 couples unmodulated calibration signals to signal port 18*sp* of transmit antenna array 18 by way of switch 216 in a calibration mode of operation. transmit antenna array 18 also receives coded signals at its control signal input port 18*c* by way of switch 226 in its calibration position. The coding applied to the control signal input port 18*c* of antenna 18 causes modulation of the calibration tone from generator 230, so that a modulated tone is transmitted, as suggested by photon symbol 410, to near-field probe antenna 18*p*. The encoded signal is received by probe 18*p*, and coupled to receiver 240. Receiver 240 provides processing as described above, and couples the received signals to decoder 246*a*. Decoder 246*b* decodes the signals, and the decoded signals are applied to processor 246*c*. Processor 248*c* determines the values of the phase shifts associated with each phase bit value of the control signal, the attenuation associated with each attenuation bit value of the control signal, or both. These signals are made available over a signal path 248 to an ACU 218. In a traffic mode of operation, the ACU control signals are coupled over switch 224 to the control input port 16*c* of receive antenna array 16.

These control signals, when applied to the control input port 16*c* or 18*c* of the receive antenna array or the transmit antenna array, respectively, modulate or encode the calibration tones.

Figure 4B:
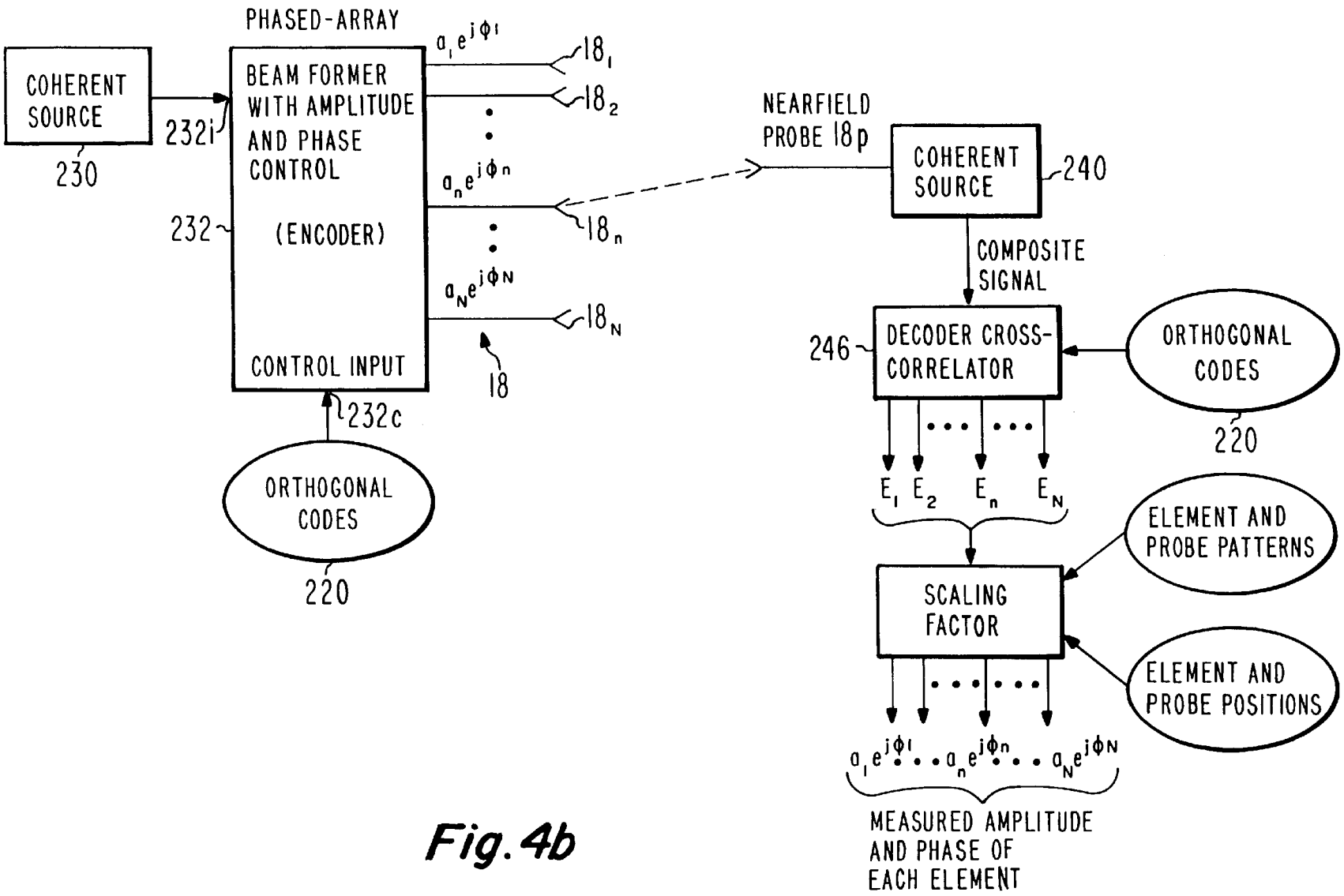
FIG. 4*b* is a simplified block of a transmit calibration scheme showing the signals used to obtain amplitude and phase measurements of the phased-array elements.

FIG. 4*b* is a simplified functional diagram illustrating the operation of the arrangement of FIG. 4*a* for near-field calibration. In FIG. 4*b*, coherent source 230 applies an unmodulated tone to a common port of a beamformer 232 which is associated with array antenna 18. Beamformer 232 also includes a control input port 232*c*. The orthogonal codes as suggested by Silverstein et al. are applied to control input port 232*c* of beamformer 232 from orthogonal code generator 220. The orthogonal codes individually modulate the various phase shifters and amplitude controllers with separately identifiable codes, so that the signals applied to the various elemental antennas $\mathbf{18}_1, \mathbf{18}_2, \ldots, \mathbf{18}_n, \ldots, \mathbf{18}_N$ of the array are encoded with the orthogonal codes. Thus, the amplitude and phase weights of the elemental signals, which may be designated $a_1e^{j\Phi 1}, a_2e^{j\Phi 2}, \ldots, a_ne^{j\Phi n}, \ldots, a_Ne^{j\Phi N}$, respectively, are modulated by the various orthogonal codes. Put another way, the various paths between the common input port 232*i* and each of the individual antenna elements $\mathbf{18}_1, \mathbf{18}_2, \ldots, \mathbf{18}_n, \ldots, \mathbf{18}_N$ of array 18 are modulated with different codes, so that a unique coding sequence is applied to each of the element paths, by toggling at least one of amplitude and phase so as to provide a unique identifier for the signal path. The near-field probe 18*p* of FIG. 4*b* receives the radiated signals from each elemental antenna $\mathbf{18}_1, \mathbf{18}_2, \ldots, \mathbf{18}_n, \ldots, \mathbf{18}_N$ of the array 18 with a phase and amplitude which depends upon the separation $r_n$ between the individual elemental antennas and the probe, and the angular separation as it affects the radiation patterns of the elemental antennas and the probe. The signals received by the probe are applied to coherent receiver 240, and the resulting signal, which is a composite of all of the individual signals from the individual elemental antennas of the array, are applied to decoder 246. Decoder 246 also receives the orthogonal code information, so that the individual elemental signals can be extracted from the composite signal. The resulting unprocessed signals are designated $E_1, E_2, \ldots, E_n, \ldots, E_N$. Each of these signals represents one of the signals flowing in an independent path extending between one of the various individual antenna elements $\mathbf{18}_1, \mathbf{18}_2, \ldots, \mathbf{18}_n, \ldots, \mathbf{18}_N$ of array antenna 18 and the near-field probe 18*p*. Consequently, the unique coding sequence applied to each of the element paths allows for simultaneous measurement of all of the elements of the phased-array antenna. More specifically, each of the signals has its relative amplitude and phase $a_ne^{jk\phi n}$ encoded with the orthogonal coding sequence. The procedure for using a Hadamard matrix to generate the orthogonal encoding and decoding sequences is described in the abovementioned Silverstein et al. patent. The processing of the signals received by the probe is performed by cross-correlating the received signal with the orthogonal codes, to produce the unprocessed signals $E_1, E_2, \ldots, E_n, \ldots, E_N$. The complex weights are given by $$E_n = a_n e^{jk\phi_n} g_n(\alpha_n^e) f(\alpha_n^p) \frac{\exp(jk_{r_n})}{r_n} \quad 1$$

where:

$r_n$ is the distance between the $n^{th}$ element and the probe;

k is the wave number $2\pi/\lambda$, where $\lambda$ is the wavelength;

$g_n(\alpha_n^e)$ are the element patterns;

$\alpha_n^e$ defines the angle relating the element pattern to the probe position;

$f(\alpha_n^p)$ is the probe pattern; and $\alpha_n^p$ defines the angle relating the probe pattern to the element position.

The a priori knowledge of the element patterns, the probe pattern, and the relative locations or positions of the various elements are used to compute a scaling factor $S_n$ given by $$S_n = \frac{r_n \exp(-jk_{r_n})}{g_n(\alpha_n^e) f(\alpha_n^p)} \quad 2$$

The relative amplitude and phase weights are then recovered using $$\alpha_n e^{jk\phi n} = s_n E_n \quad 3$$

The recovered amplitude and phase weights for each of the elements of the antenna array are then used in conventional manner to calibrate the array, and to provide for correction of the far-field pattern.

The receive array of FIG. 3 is calibrated in a manner corresponding to that of the transmit antenna of FIG. 4*a*, by applying the coherent tone source to the transmitting probe, and the receiver/decoder at the output port of a beamformer associated with the receive antenna. In calibration of the receive antenna array, the encoding is performed in the receive beamformer, and the same coherent reception, decoding, and scaling procedure is performed to recover the relative phase and amplitude for each element of the receive antenna array.

It should be noted that, in practice, the determination of the radiation patterns of the various elemental antennas of the array may require actual measurements of elements located at representative positions in the array, as for example at the center and at the edges. Similarly, actual measurements may be required in order to determine the radiation pattern of the probe antenna.

Other embodiments of the invention will be apparent to those skilled in the art. For example, while the embodiment of FIG. 2 performs calibration on only one of the receive and transmit antennas at a time, this is because a single transmit and single receive antenna have been illustrated. If there were plural transmit and receive antennas, some transmit antennas could be calibrated at the same time receive antennas were being calibrated. Those skilled in the art know that the meaning of the term "between" in electrical systems may be different from the meaning in physical arrangements, and must be interpreted in accordance with the relevant art area. While the near-field calibration invention as described is mounted on a spacecraft, it may instead be used with terrestrial antennas. While a single probe has been described as being used in conjunction with each antenna being calibrated, more than one may be used if desired. Those skilled in the art know that other methods may be used for generating sets of orthogonal coding sequences required for simultaneous measurements of the multiple antenna elements. While the described calibration arrangement is particularly advantageous for use in conjunction with phased-array antennas mounted on spacecraft, it may be used on any kind of phased-array antenna.

A near-field calibration system (FIGS. 3 or 4) calibrates at least one of (either or both of) the phase and amplitude controllers of the individual elements of an phased antenna array (16, 18). The phased antenna array (16, 18) includes a signal port (l6*sp*, 18*sp*) for each antenna beam which is generated, and also includes a control signal input port (16*c*, 18*c*) to which control signals may be applied for control of the phase and amplitude controllers. The phased antenna array (16, 18) can be operated in a normal signal-handling or traffic mode and in a calibration mode. A calibration probe (16*p*, 18*p*) is held at a fixed location relative to the phased antenna array (16, 18), and within the near-field of the phased antenna array (16, 18). A calibration tone generator (228, 230) generates a calibration tone signal. The calibration tone generator (228, 230) is (a) coupled to at least one of the signal ports (16*sp*, 18*sp*) of the phased antenna array (16, 18) for the case in which the phased antenna array (16, 18) is used as a transmit antenna during normal operation, or is (b) coupled to the calibration probe (16*p*, 18*p*) for the case in which the phased antenna array (16, 18) is used as a receive antenna during normal operation. A calibration encoder or orthogonal code generator or encoding arrangement (220) is coupled to the beam conditioning control port (16*c*, 18*c*) of the phased antenna array (16, 18), for, during calibration, sequentially setting at least some of the phase shifters (or attenuators, or both) of the phased antenna array (16, 18) with a plurality of sets of values. Each of the sets of values set by the encoding arrangement (220) imposes a coding on the calibration tone signal, to thereby sequentially generate calibration signals encoded with sets of values. Each set of values so encoded onto the calibration signals is orthogonal to other sets of values with which the calibration signals are encoded. As a result, in the case in which the phased antenna array (16, 18) is used as a transmit antenna during normal operation, the calibration probe (16*p*, 18*p*) receives the calibration tone signals sequentially encoded with mutually orthogonal values, and in the case in which the phased antenna array (16, 18) is used as a receive antenna during normal operation, the calibration tone signals sequentially encoded with mutually orthogonal values are generated at the at least one of the signal port (16*sp*, 18*sp*)s of the phased antenna array (16, 18). The system includes a decoder (246; 246*b*) for decoding signals encoded with the mutually orthogonal values, for generating decoded signals therefrom. An encoded signal coupling arrangement (18*s*, 240, 244*m*) is (a) coupled to the calibration probe (18*p*) and to the decoder (246; 246*b*) in the case in which the phased antenna array (18) is operated as a transmit antenna in the normal mode of operation and (b) coupled to the decoder (246; 246*b*) and to the signal port (16*sp*) of the phased antenna array (16) in the case in which the antenna is operated as a receive antenna in the normal mode of operation, for coupling the encoded signals to the decoder (246; 246*b*). Consequently, the decoder (246; 246*b*) generates decoded signals. A processor (246, 246*c*) is coupled to the decoder (246; 246*b*), for processing the decoded signals, for generating signals representing at least values of one of phase shift and attenuation, or both if appropriate. A coupling arrangement (248) is coupled to the processor (246, 246*c*) and to the antenna control unit (218), for coupling to the antenna control unit (218) the signals representing at least the values of phase shift, attenuation, or both, which may have been determined by the calibration system.

An antenna system according to another aspect, avatar, embodiment, hypostasis, incarnation, manifestation, mode, motif, objectification, or phase of the invention (FIG. 2) includes an transmit antenna array (18) including a signal port (18*sp*) and also including a beam conditioning signal control input port (18*c*) coupled to at least controllable phase shifters (18*pc*) of the transmit antenna array (18). A transmit calibration probe (18*p*) is affixed at a nominal location in the near field of the transmit antenna array (18). A transmit antenna switching arrangement (216) includes at least common (216*m*), calibration (216CAL), and transmit (216TFK) ports, with the common port (216*m*) being coupled to the signal port (18*sp*) of the transmit antenna array (18). The antenna system includes a source (230) of transmit antenna array (18) calibration signals. A transmit antenna array (18) calibration signal coupling arrangement (231) is coupled to the source (230) of transmit antenna array (18) calibration signals and to the calibration port (216CAL) of the transmit antenna switching arrangement (216), for controllably coupling the transmit antenna array (18) calibration signals to the signal port (18*sp*) of the transmit antenna array (18), so that the transmit antenna array (18) calibration signal, when applied to the signal port (18*sp*) of the transmit antenna array (18), is transmitted by the transmit antenna array (18). A calibration orthogonal code generator (220) sequentially generates sets of values, each set of values being orthogonal to other sets of values. A transmit antenna encoding signal coupling arrangement (222TX, 226, 227) is coupled to the calibration orthogonal code generator (220) and to the beam conditioning control signal port (18*c*) of the transmit antenna array (18), for, during calibration, coupling the calibration encoding signals to the beam conditioning control signal port (18*c*) of the transmit antenna array (18). This results in sequentially setting at least some of the phase shifters (18*pc*) of the transmit antenna array (18) with the plurality of sets of values, as a result of which, or whereby, the transmit antenna array (18) calibration probe (18*p*) receives the transmit antenna array (18) calibration signals sequentially encoded with mutually orthogonal values. The antenna system also includes an receive array antenna (16). The receive array antenna (16) includes a signal port (16*sp*) and also includes a beam conditioning signal control input port (16*c*) coupled to at least controllable phase shifters (16*pc*) of the receive array antenna (16). A receive calibration probe is affixed at a nominal location in the near field of the receive antenna array (16). A receive antenna switching arrangement (212) includes at least common (212*m*), calibration (212CAL), and receive (212TFK) ports. The common port (212*m*) of the receive antenna switching arrangement (212) is coupled (by path 210) to the signal port (16*sp*) of the receive antenna array (16). A source (228) of receive antenna array calibration signals is provided. An receive antenna array calibration signal coupling arrangement (16*s*) is coupled to the source of receive antenna array calibration signals (228) and to the receive calibration probe (16*p*), for controllably coupling the receive antenna array calibration signals to the receive calibration probe (16*p*), as a result of which, or whereby, the receive antenna array calibration signal is transmitted by the receive calibration probe (16*p*) and is received by the receive antenna array (16). A receive antenna encoding signal coupling arrangement (222*m*, 224, 225) is coupled to the calibration orthogonal code generator (220) and to the beam conditioning control signal port (16*c*) of the receive antenna array (16), for, during calibration, sequentially setting at least some of the phase shifters (16*ps*) of the receive antenna array (16) with the plurality of sets of values, whereby the receive antenna array (16) produces, at its signal port (16*sp*), receive antenna array calibration signals sequentially encoded with mutually orthogonal values. A transmit/receive calibration switch (244) including transmit signal port (244TX), receive signal port (244RX), and a common port (244*m*), couples to its common port (244*m*) signals applied to one of its transmit signal port (244TX) and its receive signal port (244RX). A first encoded signal coupling arrangement (18*s*, 239, 240) is coupled to the transmit calibration probe (18*p*) and to the transmit signal port (244TX) of the transmit/receive calibration switch (244), for coupling the transmit antenna array (18) calibration signals sequentially encoded with mutually orthogonal values to the transmit/receive calibration switch (244), as a result of which, or whereby, the transmit antenna array (18) calibration signals sequentially encoded with mutually orthogonal values are produced at the common port (244*m*) of the transmit/receive calibration switch (244) in an transmit antenna array (18) calibration mode of operation. A second encoded signal coupling arrangement (242) is coupled to the calibration port (212CAL) of the receive antenna switching arrangement (212) and to the receive port (244RX) of the transmit/receive calibration switch (244), whereby the receive antenna array calibration signals sequentially encoded with mutually orthogonal values are produced at the common port (244*m*) of the transmit/receive calibration switch (244) in an receive antenna array calibration mode of operation. An analog-to-digital converter (246ADC) includes an input port (246*i*) coupled to the common port (244*m*) of the transmit/receive calibration switch (244), for converting into digital form those analog signals applied to the input port (246*i*) of the analog-to-digital converter (246ADC), to thereby generate a digital version of the transmit antenna array (18) calibration signals sequentially encoded with mutually orthogonal values in the transmit antenna array (18) calibration mode of operation and a digital version of the receive antenna array calibration signals sequentially encoded with mutually orthogonal values in the receive antenna array calibration mode of operation. A signal processor (246*b*, 246*c*) is coupled to the analog-to-digital converter (246*a*), for decoding that one of the digital version of the transmit antenna array (18) calibration signals sequentially encoded with mutually orthogonal values and the digital version of the receive antenna array calibration signals sequentially encoded with mutually orthogonal values which is produced by the analog-to-digital converter (246*a*), to thereby generate signals representing the relationship between each bit applied to each of the phase shifters and the resulting phase of the phase shifters.

In a particular version of this system, each of the first encoded signal coupling arrangement (18*s*, 239, 240) and the second encoded signal coupling arrangement (242) comprises an electromagnetic filter for rejecting unwanted frequencies, to thereby generate filtered signals, a frequency converter, or both. The frequency converter may be a downconverter. A traffic signal processor (214) may be coupled between the receive (212TFK) port of the receive antenna switching arrangement (212) and the transmit (216TFK) port of the transmit antenna switching arrangement (216).

What is claimed is:

1. An antenna system, comprising:

an transmit antenna array including a signal port and also including a beam conditioning or beam-forming control input port coupled to at least controllable phase shifters;

a transmit calibration probe affixed at a nominal location in the near field of said transmit antenna array;

transmit antenna switching means including at least common, calibration, and transmit ports, said common port being coupled to said signal port of said transmit antenna array;

a source of transmit antenna array calibration signals;

transmit antenna array calibration signal coupling means coupled to said source of transmit antenna array calibration signals and to said calibration port of said transmit antenna switching means, for controllably coupling said transmit antenna array calibration signals to said signal port of said transmit antenna array, so that said transmit antenna array calibration signal, when applied to said signal port of said transmit antenna array, is transmitted by said transmit antenna array;

calibration encoding means for sequentially generating sets of values, each set of values being orthogonal to other sets of values;

transmit antenna encoding signal coupling means coupled to said calibration encoding means and to said beam conditioning control port of said transmit antenna array, for, during calibration, coupling said calibration encoding signals to said beam conditioning control port of said transmit antenna array, for thereby sequentially setting at least some of said phase shifters of said transmit antenna array with said plurality of sets of values, whereby said transmit antenna array calibration probe receives said transmit antenna array calibration signals sequentially encoded with mutually orthogonal values;

an receive array antenna including a signal port and also including a beam conditioning control input port coupled to at least controllable phase shifters of said receive array antenna;

a receive calibration probe affixed at a nominal location in the near field of said receive antenna array;

receive antenna switching means including at least common, calibration, and receive ports, said common port of said receive antenna switching means being coupled to said signal port of said receive antenna array;

a source of receive antenna array calibration signals;

receive antenna array calibration signal coupling means coupled to said source of receive antenna array calibration signals and to said receive calibration probe, for controllably coupling said receive antenna array calibration signals to said receive calibration probe, whereby said receive antenna array calibration signal is transmitted by said receive calibration probe and is received by said receive antenna array;

receive antenna encoding signal coupling means coupled to said calibration encoding means and to said beam conditioning control port of said receive antenna array, for, during calibration, sequentially setting at least some of said phase shifters of said receive antenna array with said plurality of sets of values, whereby said receive antenna array produces, at said signal port, receive antenna array calibration signals sequentially encoded with mutually orthogonal values;

a transmit/receive calibration switch including transmit signal port, receive signal port, and a common port, for coupling signals applied to one of said transmit signal port and said receive signal port to said common port;

first encoded signal coupling means coupled to said transmit calibration probe and to said transmit signal port of said transmit/receive calibration switch, for coupling said transmit antenna array calibration signals sequentially encoded with mutually orthogonal values to said transmit/receive calibration switch, whereby said transmit antenna array calibration signals sequentially encoded with mutually orthogonal values are produced at said common port of said transmit/receive calibration switch in an transmit antenna array calibration mode of operation;

second encoded signal coupling means coupled to said signal port of said receive antenna array switching means and to said common port of said receive antenna switching means, for, in a calibration mode of operation, coupling said receive antenna array calibration signals sequentially encoded with mutually orthogonal values to said calibration port of said receive antenna switching means, whereby said receive antenna array calibration signals sequentially encoded with mutually orthogonal values appear at said calibration port of said receive antenna switching means;

third encoded signal coupling means coupled to said calibration port of said receive antenna switching means and to said receive port of said transmit/receive calibration switch, whereby said receive antenna array calibration signals sequentially encoded with mutually orthogonal values are produced at said common port of said transmit/receive calibration switch in an receive antenna array mode of operation;

analog-to-digital conversion means including an input port coupled to said common port of said transmit/receive calibration switch, for converting into digital form those analog signals applied to said input port of said analog-to-digital conversion means, to thereby generate a digital version of said transmit antenna array calibration signals sequentially encoded with mutually orthogonal values in said transmit antenna array calibration mode of operation and a digital version of said receive antenna array calibration signals sequentially encoded with mutually orthogonal values in said receive antenna array calibration mode of operation;

signal processing means coupled to said analog-to-digital conversion means, for decoding that one of said digital version of said transmit antenna array calibration signals sequentially encoded with mutually orthogonal values and said digital version of said receive antenna array calibration signals sequentially encoded with mutually orthogonal values which is produced by said analog-to-digital conversion means, to thereby generate signals representing the relationship between a bit applied to each of said phase shifters and the resulting phase.

2. A system according to claim 1, wherein each of said first and third signal coupling means comprises an electromagnetic filter for rejecting unwanted frequencies, to thereby generate filtered signals.

3. A system according to claim 1, wherein each of said first and third signal coupling means comprises an electromagnetic filter for rejecting unwanted frequencies, to thereby generate filtered signals, and a frequency converter coupled to said filter for frequency converting said filtered signals.

4. A system according to claim 3, wherein each of said frequency converters is a downconverter.

5. A system according to claim 1, further comprising:

traffic signal processing means coupled between said receive port of said receive antenna switching means and said transmit port of said transmit antenna switching means.

6. A near-field calibration system for calibrating at least one of the phase and amplitude controllers of the individual elements of a phased-array antenna which may be operated in a normal signal-handling mode and in a calibration mode, in which said phased-array antenna includes a signal port for each individual beam which said antenna generates, and also includes a control signal input port to which control signals are applied for control of said phase and amplitude controllers, said calibration system comprising:

a calibration probe located at a fixed position relative to said phased-array antenna, and within the near-field of said phased-array antenna;

a calibration tone generator for generating a calibration tone signal, said calibration tone generator being (a) coupled to at least one of said signal ports of said phased-array antenna for the case in which said phased-array antenna is used as a transmit antenna during normal operation, and (b) coupled to said calibration probe for the case in which said phased-array antenna is used as a receive antenna during normal operation;

calibration encoding means coupled to said beam conditioning control port of said phased-array antenna, for, during calibration, sequentially setting at least some of said phase shifters of said phased-array antenna with a plurality of sets of values, each of said sets of values imposing a coding on the calibration tone signal, to thereby sequentially generate calibration signals encoded with sets of values, each set of values so encoded onto said calibration signals being orthogonal to other sets of values with which said calibration signals are encoded, whereby, in the case in which said phased-array antenna is used as a transmit antenna during normal operation, said calibration probe receives said calibration tone signals sequentially encoded with mutually orthogonal values, and in the case in which said phased-array antenna is used as a receive antenna during normal operation, said calibration tone signals sequentially encoded with mutually orthogonal values are generated at said at least one of said signal ports of said phased-array antenna;

a decoder for decoding signals encoded with said mutually orthogonal values, for generating decoded signals therefrom;

encoded signal coupling means (a) coupled to said calibration probe and to said decoder in the case in which said phased-array antenna is operated as a transmit antenna in said normal mode of operation and (b) coupled to said decoder and to said signal port of said phased-array antenna in the case in which said antenna is operated as a receive antenna in said normal mode of operation, for coupling said encoded signals to said decoder, as a result of which said decoder generates said decoded signals;

a processor coupled to said decoder, for processing said decoded signals for generating signals representing at least the values of one of phase shift and attenuation; and coupling means coupled to said processor and to said antenna control unit, for coupling to said antenna control unit said signals representing at least the values of one of phase shift and attenuation.

7. A method for calibrating an array antenna, said method comprising the steps of:

generating a calibration tone signal:

in the case of a transmit antenna, applying said calibration tone signal to the signal input port of said array antenna, and in the case of a receive antenna, applying said calibration tone signal to a probe antenna located in the near field of said array antenna;

sequentially generating encoding signals including sets of values, each set of values being orthogonal to other sets of values;

applying said encoding signals to a control input port of said array antenna for control of at least the phase shifters thereof, whereby said calibration tone signal traversing said array antenna is encoded with said values to thereby produce encoded calibration signals;

coupling said encoded calibration signals to a decoder, for decoding said sets of values to produce decoded signals; and processing said decoded signals to produce signals representative of the phase shift resulting from said encoding signals.

* * * * *